US011498104B2

(12) United States Patent
Park et al.

(10) Patent No.: US 11,498,104 B2
(45) Date of Patent: Nov. 15, 2022

(54) EXTRUSION APPARATUS AND METHOD FOR MANUFACTURING ALUMINUM CAPILLARY TUBE USING SAME

(71) Applicant: Samsung Electronics Co., Ltd., Suwon-si (KR)

(72) Inventors: Sungtae Park, Suwon-si (KR); Myounghun Kim, Suwon-si (KR); Sangjun Park, Suwon-si (KR); Won Ju, Suwon-si (KR); Jungsoo Lim, Suwon-si (KR); Kookjeong Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/986,174

(22) Filed: Aug. 5, 2020

(65) Prior Publication Data

US 2021/0039149 A1 Feb. 11, 2021

(30) Foreign Application Priority Data

Aug. 5, 2019 (KR) ..... 10-2019-0095131

(51) Int. Cl.
*B21C 23/08* (2006.01)
*B21C 23/00* (2006.01)

(52) U.S. Cl.
CPC ..... *B21C 23/085* (2013.01); *B21C 23/002* (2013.01)

(58) Field of Classification Search
CPC ..... B21C 25/02; B21C 25/04; B21C 23/002; B21C 23/085; B21C 23/21; B21C 23/217; B21C 23/08; B21C 23/212
(Continued)

(56) References Cited

U.S. PATENT DOCUMENTS 1,370,328 A * 3/1921 Lowe ..... B21C 23/085 72/259
3,394,579 A * 7/1968 Hall ..... B21C 23/08 72/261
(Continued)

FOREIGN PATENT DOCUMENTS

EP 1840487 B1 10/2013
JP 01273610 A * 11/1989 ..... B21C 23/142
(Continued)

OTHER PUBLICATIONS

Quantum Alloys LTD, Aluminum Profiles, Jun. 12, 2019, Quantum Alloys LTD (Year: 2019).*
(Continued)

*Primary Examiner* — Teresa M Ekiert

(57) ABSTRACT

An extrusion apparatus and a method for manufacturing an aluminum capillary tube using the same are provided. The extrusion apparatus includes a container, a housing mold provided on one side of the container and including a plurality of dies formed with a plurality of holes, and a ram pressing an aluminum billet accommodated in the container in a direction from another side to the one side of the container so that the aluminum billet accommodated in the container is extruded into a plurality of aluminum capillary tubes having cross-sectional shapes corresponding to the plurality of holes, and the number of the plurality of holes is determined based on an inner diameter of the container and a diameter of each of the plurality of holes.

16 Claims, 13 Drawing Sheets

(58) Field of Classification Search
USPC ..... 72/253.1, 264, 269
See application file for complete search history.

(56) References Cited

U.S. PATENT DOCUMENTS

| | | | | |
|---|---|---|---|---|
| 4,332,156 | A * | 6/1982 | Broodman | B21C 23/14 29/890.053 |
| 4,606,210 | A * | 8/1986 | Wagner | B21C 23/218 72/261 |
| 7,849,915 | B2 * | 12/2010 | Kawakubo | F28F 1/022 165/177 |
| 8,584,501 | B2 | 11/2013 | Kim et al. | |
| 8,650,927 | B1 | 2/2014 | Kim et al. | |
| 2002/0070012 | A1 * | 6/2002 | Kraft | F28D 1/05383 165/177 |
| 2002/0121120 | A1 * | 9/2002 | Kraft | B21C 35/023 72/254 |
| 2003/0124214 | A1 * | 7/2003 | Yano | B21C 25/02 425/380 |
| 2004/0069036 | A1 | 4/2004 | Hirsch et al. | |
| 2007/0181235 | A1 * | 8/2007 | Spinat | C22C 23/02 148/667 |
| 2009/0293570 | A1 * | 12/2009 | Hiramoto | B21C 25/00 72/264 |
| 2011/0041582 | A1 | 2/2011 | Kim et al. | |
| 2014/0060140 | A1 | 3/2014 | Kim et al. | |
| 2014/0102159 | A1 * | 4/2014 | Denison | B21C 25/02 72/253.1 |

FOREIGN PATENT DOCUMENTS

| | | | |
|---|---|---|---|
| JP | H05-131214 | A | 5/1993 |
| JP | 4938501 | B2 | 5/2012 |
| KR | 10-2002-0023029 | A | 3/2002 |
| KR | 10-0573314 | B1 | 4/2006 |
| KR | 10-0982534 | B1 | 9/2010 |
| KR | 10-2012-0129671 | A | 11/2012 |
| KR | 10-1492122 | B1 | 2/2015 |
| KR | 10-1554982 | B1 | 9/2015 |
| KR | 101589935 | B1 | 1/2016 |
| KR | 10-1952550 | B1 | 2/2019 |

OTHER PUBLICATIONS

ASTM, Standard Specification for Aluminum and Aluminum-Alloy Extruded Bars, Rods, Wire, Profiles, and Tubes ,Oct. 1, 2014, ASTM Commitee, DOI: 10.1520/B0221-14, Table 1 (Year: 2014).*

Accurate Sensors Technologies, Aluminum Extrusion, 2018, Accurate Sensors Technologies, http://www.accuratesensors.com/wp-content/uploads/2018/12/Aluminium-Extrusion.pdf (Year: 2018).*

Aluminum Machinery Total Solution Provider, How to optimized aluminum extrusion and heat treatment processes, Jun. 10, 2019, Brightstar Aluminum Machinery https://www.machine4aluminium.com/how-to-optimize-aluminum-extrusion-and-heat-treatment-processes/ (Year: 2019).*

International Search Report and Written Opinion of the International Searching Authority in connection with International Application No. PCT/KR2020/010254 dated Nov. 3, 2020, 9 pages.

* cited by examiner

FIG. 5A

| CATEGORY | INNER DIAMETER [mm] | OUTER DIAMETER [mm] |
|---|---|---|
| 1 | 0.70 | 1.8 |
| 2 | 0.75 | 2.0 |
| 3 | 0.80 | 1.8 |
| 4 | 0.80 | 1.9 |
| 5 | 0.85 | 1.9 |
| 6 | 0.85 | 2.3 |
| 7 | 0.85 | 2.9 |
| 8 | 0.85 | 3.9 |
| 9 | 0.90 | 1.9 |
| 10 | 0.90 | 2.3 |
| 11 | 0.90 | 2.9 |
| 12 | 0.90 | 3.9 |

FIG. 6

| CATEGORY | YIELD STRENGTH [MPa] | TENSILE STRENGTH [MPa] | ELONGATION RATE [%] | CROSS SECTION REDUCTION RATIO [%] |
|---|---|---|---|---|
| EXTRUSION TUBE | 42~44 | 73~74 | 13~15 | - |
| FIRST STEP DRAWING | 100 | 100 | 0 | 39.5 |
| SECOND STEP DRAWING | 110 | 110 | 0 | 60.7 |
| THIRD STEP DRAWING | 120 | 120 | 0 | 76.1 |
| FOURTH STEP DRAWING | 127 | 127 | 0 | 85.6 |

EXTRUSION APPARATUS AND METHOD FOR MANUFACTURING ALUMINUM CAPILLARY TUBE USING SAME

CROSS-REFERENCE TO RELATED APPLICATIONS

This application is based on and claims priority under 35 U.S.C. § 119 to Korean Patent Application No. 10-2019-0095131 filed on Aug. 5, 2019 in the Korean Intellectual Property Office, the disclosure of which is incorporated by reference herein in its entirety.

BACKGROUND

1. Field

The disclosure relates to an extrusion apparatus and a method for manufacturing an aluminum capillary tube using the same, more particularly relates to an extrusion apparatus having a multi-hole structure and a method for manufacturing an aluminum capillary tube using the same.

2. Description of the Related Art

A capillary tube is a thin and long tube functioning as a flow path so that a fluid flows therein. Since the capillary tube is an apparatus with a relatively simple structure with no movable part, it is advantageous in that there is no need for repair due to abrasive wear.

The capillary tube is generally manufactured through processes of extrusion, multi-step drawing, and annealing, in order to perform firing working using copper to have a diameter suitable for design dimension. The extrusion is hot working mostly performed at a high temperature and is a method for processing a material to be processed to have a cross section with a constant shape by passing the material to be processed through a die, and the drawing is cold working mostly performed at a room temperature and is a method for drawing a material to be processed having a shape of a rod, a wire, and a tube to process the material to be processed to have a reduced cross section.

In recent years, attempts have been made for replacing copper for diversification of materials. Aluminum is attracting attention as a material for replacing the copper capillary tube, since aluminum has excellent properties such as workability, lightness, and conductivity by itself, as the most abundant metal among elements constituting the Earth's crust, and aluminum is also easily alloyed with other metals and able to have various material properties in accordance with components of the alloying element thereof.

In a case of manufacturing a capillary tube using an aluminum alloy through the extrusion process of the hot working, the properties and corrosion resistance of the aluminum alloy may be maintained, but an extrusion speed may decrease due to a low extrusion ratio due to a small diameter of the capillary tube. Accordingly, the capillary tube may not be able to be manufactured or the production cost may increase due to requirement of additional processes. In addition, in a case of manufacturing a capillary tube using an aluminum alloy through multi-steps of the drawing of the cold working, fracture may occur later in a forming process such as bending due to an increase in strength and a decrease in elongation rate due to work hardening, and stress corrosion may occur in a corrosive environment due to an increase in internal stress in accordance with irregular change of structure of internal particles, thereby reducing corrosion resistance.

In particular, in order to replace copper, the aluminum capillary tube should maintain properties such as corrosion resistance even after the aluminum alloy is processed into the aluminum capillary tube. Therefore, it is necessary to optimize and/or improve a process for manufacturing a capillary tube satisfying diameters of a design specification, while maintaining original material properties and corrosion resistance of the aluminum alloy.

SUMMARY

In accordance with an aspect of the disclosure, there is provided an extrusion apparatus including a container, a housing mold provided on one side of the container and including a plurality of dies formed with a plurality of holes, and a ram pressing an aluminum billet accommodated in the container in a direction from another side to the one side of the container so that the aluminum billet accommodated in the container is extruded into a plurality of aluminum capillary tubes having cross-sectional shapes corresponding to the plurality of holes, in which the number of the plurality of holes is determined based on an inner diameter of the container and a diameter of each of the plurality of holes.

In accordance with an aspect of the disclosure, there is provided a method for manufacturing an aluminum capillary tube using an extrusion apparatus including a container, and a housing mold provided on one side of the container and including a plurality of dies formed with a plurality of holes, the method including inserting an aluminum billet to the container, heating the aluminum billet, and pressing the aluminum billet in a direction from another side to the one side of the container so that the aluminum billet is extruded into a plurality of aluminum capillary tubes having cross-sectional shapes corresponding to the plurality of holes, in which the number of the plurality of holes is determined based on an inner diameter of the container and a diameter of each of the plurality of holes.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 5A illustrates a view for explaining a diameter ratio according to an embodiment;

FIG. 6 illustrates a view for explaining a manufacturing method according to an embodiment.

DETAILED DESCRIPTION

Figure 1A:
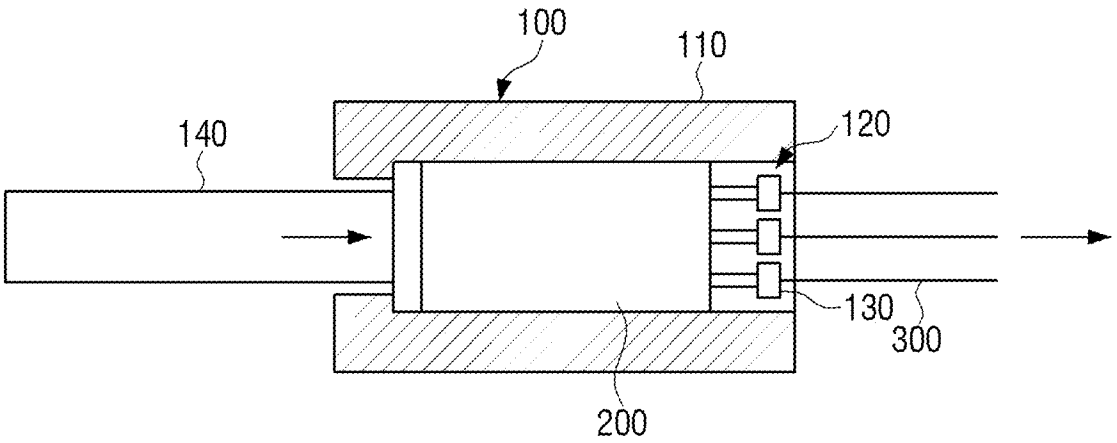
FIG. 1A illustrates a view for explaining an extrusion apparatus according to an embodiment.

FIGS. 1A through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

An object of the disclosure is to provide an extrusion apparatus for manufacturing a capillary tube satisfying diameters of a design, while maintaining original material properties and corrosion resistance of an aluminum alloy, and a method for manufacturing an aluminum capillary tube using the same.

In describing the disclosure, a detailed description of the related art or configuration is omitted when it is determined that the detailed description may unnecessarily obscure a gist of the disclosure. In addition, the embodiments below may be changed in various forms and the scope of the technical idea of the disclosure is not limited to the embodiments below. The embodiments are provided to complete the disclosure and completely transfer the technical idea of the disclosure to those skilled in the art.

It should be noted that the technologies disclosed in this disclosure are not for limiting the scope of the disclosure to a specific embodiment, but they should be interpreted to include all modifications, equivalents and/or alternatives of the embodiments of the disclosure. In relation to explanation of the drawings, similar reference numerals may be used for similar elements.

The expressions "first," "second" and the like used in the disclosure may denote various elements, regardless of order and/or importance, and may be used to distinguish one element from another, and does not limit the elements.

In this disclosure, expressions such as "A or B", "at least one of A and/or] B,", or "one or more of A and/or] B," include all possible combinations of the listed items. For example, "A or B", "at least one of A and/or B,", or "at least one or more of A and/or B" may be interpreted to include any of (1) A, (2) B, or (3) A and B, unless otherwise noted, and other elements may also be further included in this case.

In the disclosure, unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

If it is described that a certain element (e.g., first element) is "operatively or communicatively coupled with/to" or is "connected to" another element (e.g., second element), it should be understood that the certain element may be connected to the other element directly or through still another element (e.g., third element). On the other hand, if it is described that a certain element (e.g., first element) is "directly coupled to" or "directly connected to" another element (e.g., second element), it may be understood that there is no element (e.g., third element) between the certain element and the another element.

Also, the expression "configured to" used in the disclosure may be interchangeably used with other expressions such as "suitable for," "having the capacity to," "designed to," "adapted to," "made to," and "capable of," depending on cases. Meanwhile, the expression "configured to" does not necessarily refer to a device being "specifically designed to" in terms of hardware.

FIG. 1A illustrates a view for explaining an extrusion apparatus according to an embodiment.

Referring to FIG. 1A, an extrusion apparatus 100 according to an embodiment of the disclosure may extrude an aluminum billet 200 into a plurality of aluminum capillary tubes 300. The extrusion herein may refer to hot working of heating the aluminum billet 200 and pressing the aluminum billet 200 having fluidity (or flowability) in a direction of an arrow, to deform the aluminum billet 200 in a shape having a cross section with a specific size continuously (e.g., tube, wire, or the like).

For this, the extrusion apparatus 100 may include a container 110, and a housing mold 120 including a plurality of dies 130, and a ram 140.

The container 110 may accommodate the aluminum billet 200. For this, an insertion opening for inserting the aluminum billet 200 and an accommodation space for accommodating the inserted aluminum billet 200 may be formed in the container 110. In this case, the accommodation space may be formed to have a size larger than the aluminum billet 200 to accommodate the aluminum billet 200 and may be formed to have the same shape as the shape of the aluminum billet 200 (e.g., cylindrical shape or the like). The size may be represented in various units such as a diameter of a cross section, a length of a cylinder, the entire volume, and the like.

The extrusion apparatus 100 according to an embodiment of the disclosure may further include a heater. The heater may be included in the extrusion apparatus 100 or the heater may also be implemented as a separate apparatus outside of the extrusion apparatus 100.

Specifically, if the heater is included in the extrusion apparatus 100, the container 110 and the plurality of dies 130 may be heated or the aluminum billet 200 inserted into the container 110 may be heated. If the heater is implemented as a separate apparatus outside of the extrusion apparatus 100, the aluminum billet 200 may be heated outside and then the aluminum billet 200 may be inserted into the container 110 of the extrusion apparatus 100. For this, the heater may be implemented as a device which is able to generate heat using various methods such as convection, conduction, radiation, induction, or the like.

In this case, the heater may heat (or preheat) the aluminum billet 200 at a temperature (e.g., 400 to 480 degrees) equal to or lower than a melting point within a predetermined period of time (e.g., 5 hours), and fluidity (or flowability) of the aluminum billet 200 may increase in accordance with an increase in temperature due to heating.

The housing mold 120 may be provided on one side of the container 110. The housing mold 120 may include the plurality of dies 130.

The plurality of dies 130 may be formed with a plurality of holes 136 (see FIG. 2C), respectively. When the aluminum billet 200 is extruded into the plurality of capillary tubes 300, cross-sectional shapes of the plurality of the aluminum capillary tubes 300 may correspond to the plurality of holes 136 formed on the plurality of dies 130. In other words, the cross-sectional shape of the aluminum capillary tube 300 may correspond to the hole 136 formed on the die 130.

The number of plurality of holes 136 may be determined based on an inner diameter of the container 110 and a diameter of each of the plurality of holes 136. In other words, the number of the plurality of holes 136 may be determined so that an extrusion ratio becomes a predetermined value or more. The extrusion ratio herein may refer to a ratio of cross-sectional areas before extrusion and after extrusion (or input and output). In addition, the extrusion ratio may refer to a ratio of diameters before extrusion and after extrusion.

Specifically, in a case of pressing the preheated aluminum billet 200 by the ram 140, the inner diameter of the container 110 may be a diameter before the extrusion, since the aluminum billet 200 flows to have the same diameter as the inner diameter of the container 110. Since an outer diameter of the aluminum capillary tube 300 is the same as (or corresponds to) the diameter of the hole 136, the diameter of each of the plurality of holes 136 may be the diameter after extrusion.

For example, since the inner diameter of the container 110 is 15.24 cm (6 inches), whereas the outer diameter of each of the plurality of aluminum capillary tubes 300 is 2.0 mm, the number of the plurality of holes 136 may be 2. However, in this case, a pressure applied to a surface of the housing mold 120 may increase due to a small cross-sectional area of the plurality of aluminum capillary tubes 300 to be extruded, thereby reducing the extrusion speed. In this case, the number of the plurality of holes 136 is suitably 4. However, this may vary depending on a size of the billet and original material properties.

The housing mold 120 and the plurality of dies 130 will be described below in detail with reference to FIGS. 2A to 3B.

The ram 140 may press the aluminum billet 200 accommodated in the container 110 in a direction from the other side to the one side of the container 110. Herein, the one side of the container 110 may be a position where the plurality of dies 130 are present, and the other side thereof may be a position opposite to the one side. For example, the ram 140 may press the aluminum billet 200 accommodated in the container 110 in a direction of an arrow. Accordingly, the aluminum billet 200 accommodated in the container 110 may be extruded into the plurality of aluminum capillary tubes 300 having cross-sectional shapes corresponding to the plurality of holes.

For this, the ram 140 may be implemented in an operation method such as a mechanic or hydrodynamic method, and in this case, the ram 140 may move forward at a predetermined speed (e.g., 60, 140, or 240 mm/min) so that a part of the aluminum billet 200 accommodated in the container 110 in a preheated state may be extruded into the plurality of aluminum capillary tubes 300 through the plurality of holes 136 formed on the plurality of dies 130 due to the pressure generated when the ram 140 moves forward. In addition, the ram 140 may include a dummy block to uniformly transfer the pressure to the aluminum billet 200. In this case, the dummy block may be positioned between the ram 140 and the aluminum billet 200 and formed in a shape and a size according to the cross-sectional shape and the size of the aluminum billet 200.

The aluminum billet 200 may refer to an aluminum alloy having a shape and a size easy to be extruded, as a material to be processed through the extrusion. For example, the aluminum billet 200 may be realized in a cylindrical shape and may be realized to have a predetermined diameter (e.g., 6 inches (approximately 15.24 cm)) and a predetermined length (e.g., 70 cm) in accordance with the size (or volume) of the container 110. However, the shape and the size of the aluminum billet 200 described above are merely an embodiment, and the aluminum billet 200 may be realized in various shapes such as a square column, a pentagonal column, a hexagonal column, an elliptical column, and the like, and various sizes. Hereinafter, for convenience of description, the description will be made by assuming that the shape of the aluminum billet 200 is a cylinder and the diameter thereof is 6 inches.

For this, the aluminum billet 200 may be manufactured through a dissolution process, an allying process, a degassing treatment process, and the like. For example, the aluminum billet 200 may be manufactured by melting aluminum at a temperature of 650 to 750 degrees, adding an alloying element to the melted aluminum, allowing alloying by holding the mixture for 10 minutes to 1 hour, and performing degassing treatment by injecting inert gas (e.g., argon bubbling gas).

In this case, Mg and Zn may be added to the aluminum billet 200 as alloying elements. This is for improving corrosion resistance or mechanical physical properties.

The aluminum billet 200 may contain 0.20 to 0.40% by weight of Mg; and 0.20 to 0.60% by weight of Zn; and a balance of Al, with respect to a weight of the entire composition. This is for improving corrosion resistance of the aluminum billet 200 to an equivalent level as copper.

The balance may refer to materials of the aluminum billet 200 except for the alloying elements, Mg and Zn, and the balance of Al may not preclude containing of alloying elements other than aforementioned the alloying elements or impurities, in addition to the Al elements. For example, the other alloying elements may include at least one alloying element among Si, Fe, Mn, and Cu, and in this case, the aluminum billet 200 may contain less than 5.0% by weight of Si, Fe, Mg, Zn, Mu, and Cu; and a balance of Al. The balance of Al may contain inevitable impurities during the manufacturing process such as the alloying process, the thermal treatment process, or the extrusion process. In this case, it is preferable that the amount of the impurities does not exceed 1.0% by weight.

The properties (e.g., strength, corrosion resistance, and the like) of the aluminum billet 200 may be affected by a state of fine structures (e.g., precipitates due to thermal treatment), in addition to the weight ratio (e.g., % by weight) of the composition.

Specifically, if the aluminum billet 200 contains Mg, Zn, and the balance of Al, at least one of a $Mg_{32}(Al, Zn)_{49}$ phase and a $Al_3Mg_2$ phase may be formed. In this case, a fraction of a compound phase to be formed may vary depending on the content (% by weight) of the Mg and Zn. For example, according to an embodiment of the disclosure, assuming that the content of Mg in the aluminum billet 200 is 0.30% by weight and the content of Zn is 0.50% by weight, the fraction of $Mg_{32}(Al, Zn)_{49}$ phase may be 0.021% and the fraction of $Al_3Mg_2$ phase may be 0.003%.

Meanwhile, it is preferable that the fraction of the $Mg_{32}(Al, Zn)_{49}$ phase contained in the aluminum billet 200 does not exceed 0.05%. It is preferable that the fraction of the $Al_3Mg_2$ phase contained in the aluminum billet 200 does not exceed 0.02%. In other words, if the fraction of the $Mg_{32}(Al, Zn)_{49}$ phase exceeds 0.05% or the fraction of the $Al_3Mg_2$ phase exceeds 0.02%, it is difficult to ensure workability for extrusion or drawing.

As described above, local corrosion (pitting or crevice corrosion) of the aluminum billet 200 may be reduced by at least one of the $Mg_{32}(Al, Zn)_{49}$ phase and the $Al_3Mg_2$ phase contained in the aluminum billet 200. In other words, the corrosion resistance of the aluminum billet 200 may be improved by at least one of the $Mg_{32}(Al, Zn)_{49}$ phase and the $Al_3Mg_2$ phase formed. More specifically, the $Mg_{32}(Al, Zn)_{49}$ phase and the $Al_3Mg_2$ phase may reduce a potential difference from Al matrix on a grain boundary to reduce the local corrosion of the surface. Particularly, if the fractions of the $Mg_{32}(Al, Zn)_{49}$ phase and the $Al_3Mg_2$ phase are degrees so as to be distributed continuously on the grain boundary, the effect of the improvement of the corrosion resistance may be more significantly exhibited.

Figure 1B:
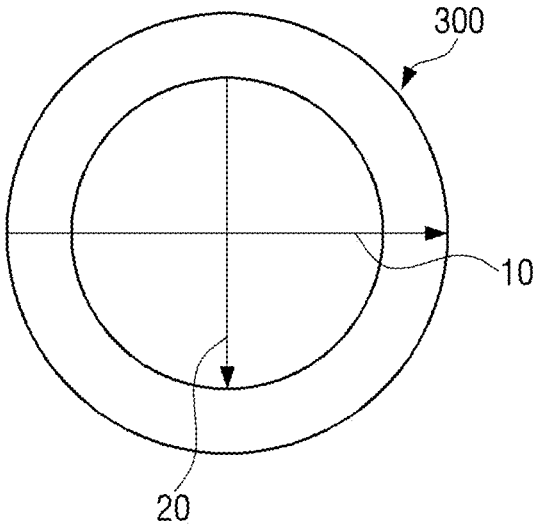
FIG. 1B illustrates a view for explaining an aluminum capillary tube according to an embodiment.
Figure 1C:
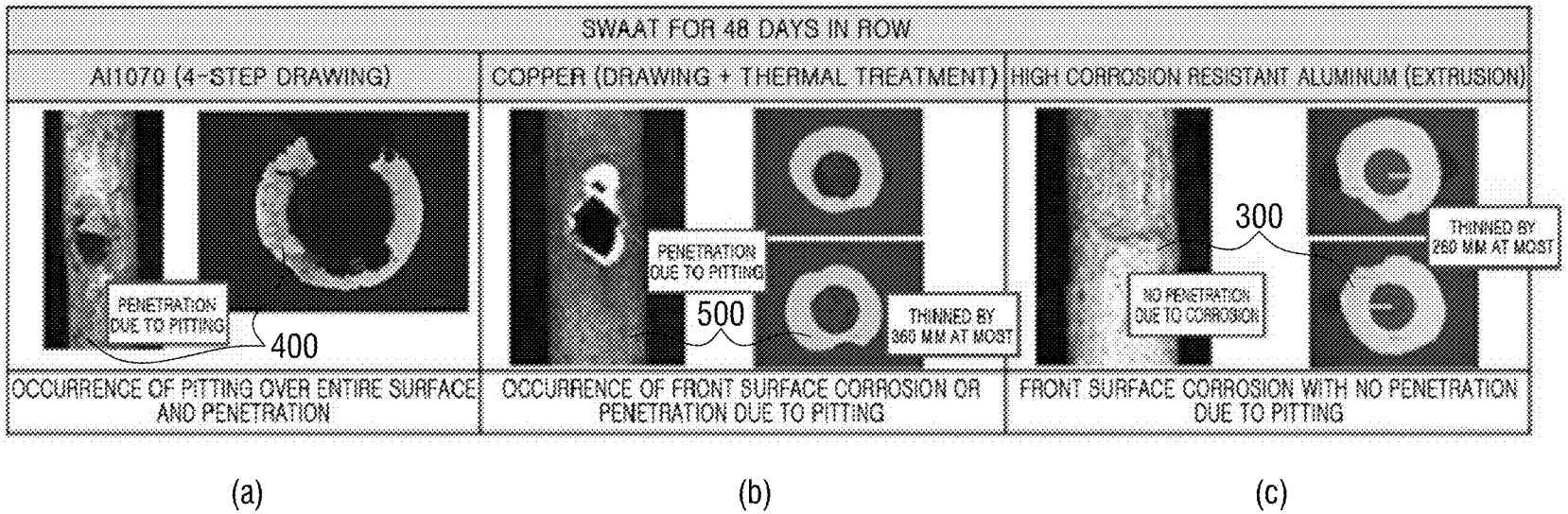
FIG. 1C illustrates a view for explaining the aluminum capillary tube according to an embodiment.

Hereinafter, an aluminum capillary tube manufactured using the extrusion apparatus according to an embodiment of the disclosure will be described with reference to FIGS. 1A to 1C. FIG. 1B illustrates a cross section of the aluminum capillary tube in a direction orthogonal to the arrow (pressing direction) of FIG. 1A. FIG. 1C illustrates a view for comparing corrosion resistance between the aluminum capillary tube and a comparative group according to an embodiment of the disclosure.

The aluminum capillary tube 300 is a tube having a thin and long structure functioning as a flow path for a fluid to flow therein, and a flow rate, a pressure, or a temperature of a fluid present therein may be controlled in accordance with a length and a diameter designed. The fluid is a material having irregular shape and having fluidity to freely flow, and may refer to single phase liquid or gas or a two-phase mixture obtained by mixing these.

In this case, the aluminum capillary tube 300 may be used for various purposes across industries. For example, the aluminum capillary tube 300 may be used as an expansion device for connecting a condenser and an evaporator of a refrigerator, an air conditioner, or a water cooler. The aluminum capillary tube 300 may cause pressure drop due to a length, an inner diameter, or frictional resistance of an inner wall, and may cause temperature drop of decreasing an external temperature by allowing an endothermic reaction, when a liquid-phase fluid in the aluminum capillary tube 300 is vaporized due to the pressure drop of the aluminum capillary tube 300. In addition, the aluminum capillary tube 300 may be used for various purposes of a medical tube, a pressure gauge tube, cold and hot water pipes, an oil pipe, a gas pipe, and the like.

For this, the aluminum capillary tube 300 may be extruded in a hollow inner structure (e.g., tube, pipe, or the like). Specifically, a cross-sectional shape of the aluminum capillary tube 300 may be formed in a doughnut shape (circle or ellipse with a hollow inner part). However, this is merely an embodiment, and the cross-sectional shape of the aluminum capillary tube 300 may be formed in one of various shapes such as a triangle, a square, a pentagon with a hollow inner part. Hereinafter, for convenience of description, the description will be made by assuming that the cross-sectional shape of the aluminum capillary tube 300 is a doughnut shape.

Referring to FIG. 1B, the size of the aluminum capillary tube 300 may be shown with an outer diameter 10 and an inner diameter 20. For example, the aluminum capillary tube 300 may be extruded so that a dimension of the outer diameter 10 is 1.8 mm to 2.1 mm and a dimension of the inner diameter 20 is 0.8 mm to 0.9 mm. This will be described below in detail with reference to FIGS. 5A and 5B.

Referring to FIGS. 1A and 1C, the aluminum capillary tube 300 may be manufactured by extruding the aluminum billet 200 using the extrusion apparatus 100 according to an embodiment of the disclosure. In other words, in the disclosure, the plurality of aluminum capillary tubes 300 may be manufactured through only a single process of the extrusion of the aluminum billet 200 using the extrusion apparatus 100. As described above, since the extrusion apparatus 100 according to an embodiment of the disclosure may manufacture the aluminum capillary tube 300 through the multi-hole extrusion process, the productivity is further improved more than double, compared to a single-hole extrusion process, and it is effective to reduce cost due to simplification of the process, since the aluminum capillary tube 300 may be manufactured without post-process.

For example, FIG. 1C illustrates (a) Al 1070 capillary tube 400 manufactured through a drawing process of 4 steps, (b) a copper capillary tube 500 manufactured through drawing and thermal treatment processes, and (c) the aluminum capillary tube 300 manufactured according to an embodiment of the disclosure, which are subjected to a seawater acetic acid test (SWAAT) which is one of corrosion resistance tests. Particularly, in a case of (c), the aluminum billet 200 and the housing mold 120 were preheated at a temperature of 400 to 480 degrees within 5 hours, the aluminum billet 200, after preheating, was inserted into the container 110 of the extrusion apparatus 100, and the aluminum capillary tube 300 was manufactured by a direct extrusion method by maintaining a temperature of the container 110 at 400 to 480 degrees and setting an extrusion speed of the ram at 30 to 60 m/min.

In a case of (a) of FIG. 1C, penetration has occurred due to pitting over the entire surface, and accordingly, as shown in FIG. 6, internal stress and surface defects may increase due to the drawing, and accordingly, strength may increase, but an elongation rate may significantly decrease. With such a change, corrosion resistance of the material may significantly decrease. In a case of (b) of FIG. 1C, penetration has occurred due to front surface corrosion or pitting, and as illustrated in (c) of FIG. 1C, no penetration due to corrosion has occurred in the aluminum capillary tube 300 manufactured according to an embodiment of the disclosure, and it is found that a depth of a thinned wall is comparatively smaller than that in the case of copper.

As described above, the aluminum capillary tube 300 according to an embodiment of the disclosure has an effect of properties of high corrosion resistance while maintaining physical and chemical properties of the aluminum billet 200 through the extrusion.

As described above, the aluminum capillary tube 300 manufactured according to an embodiment of the disclosure may be replaced with a capillary tube using copper, since the aluminum capillary tube 300 has high corrosion resistance which is the same as that of a normal capillary tube using copper and the effects of cost reduction and productivity improvement due to simplification of process are exhibited.

Hereinafter, the housing mold 120 and the plurality of dies 130 will be described in detail with reference to FIGS. 2A to 3B.

Figure 2A:
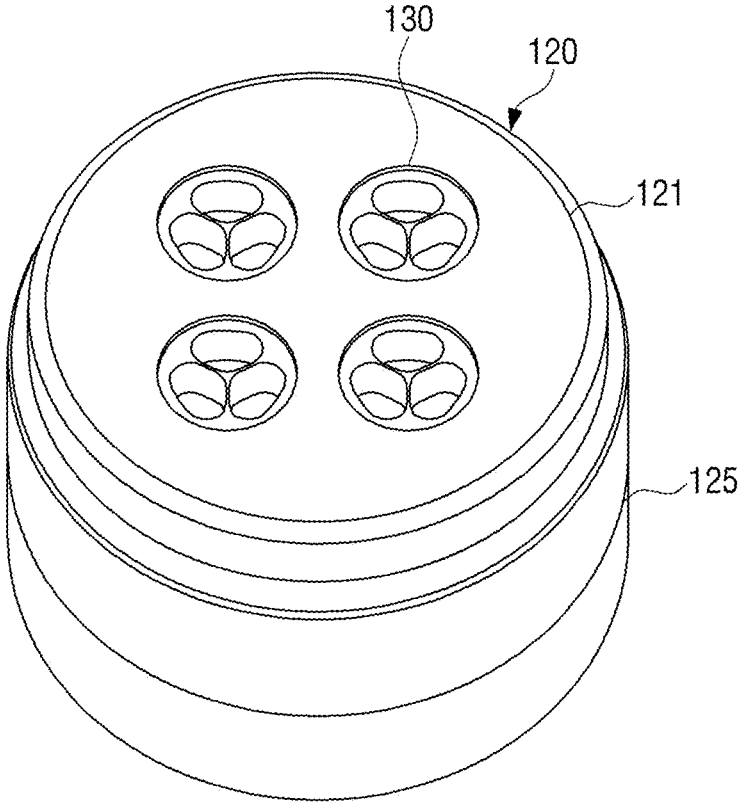
FIG. 2A illustrates a view for explaining a housing mold according to an embodiment.
Figure 2B:
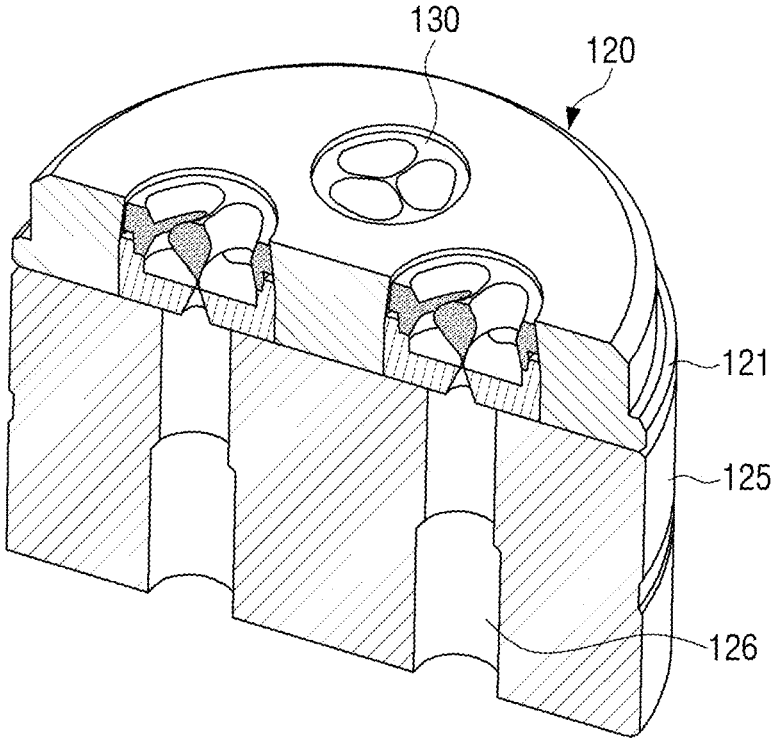
FIG. 2B illustrates a view for explaining the housing mold according to an embodiment.
Figure 2C:
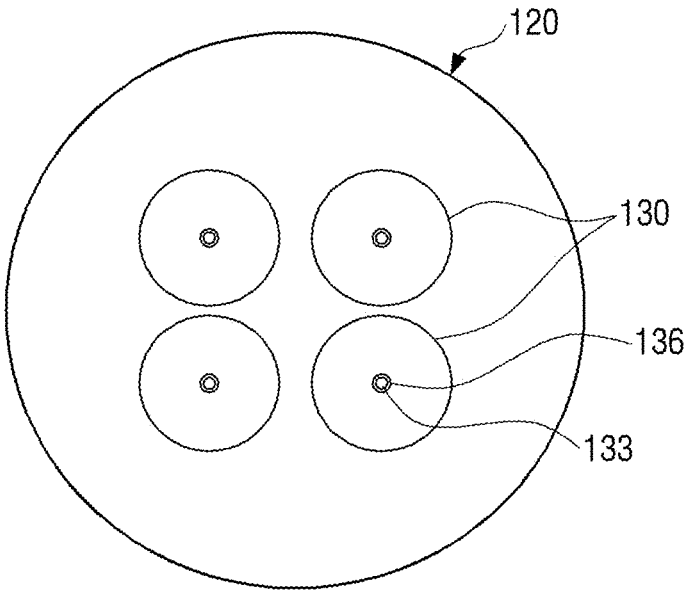
FIG. 2C illustrates a view for explaining the housing mold according to an embodiment.

FIGS. 2A to 2C are views for explaining the housing mold according to an embodiment. FIG. 2A illustrates a perspective view of the housing mold, FIG. 2B illustrates a vertical sectional view of the housing mold, and FIG. 2C illustrates a horizontal sectional view of the housing mold.

Referring to FIG. 2A to 2C, the housing mold 120 may include the plurality of dies 130. This may imply that the housing mold 120 is combined with the plurality of dies 130. The plurality of dies 130 may be detachable from the housing mold 120.

The housing mold 120 may be combined with the plurality of dies 130 to support the plurality of dies 130. For this, the housing mold 120 may include a die holder 121, a die backer 125 combined with the die holder 121, and the plurality of dies 130 combined with the die holder 121 and the die backer 125.

The die holder 121 is for fixing the plurality of dies 130 at specific positions and the same number of openings as the number of plurality of dies 130 may be formed. In this case, the plurality of dies 130 may be combined with the plurality of openings formed on the die holder 121, respectively. The die holder 121 may be combined with the die backer 125 positioned on the back. Hereinafter, a direction from one side of the container 110 (position of the housing mold 120) to another side of the container 110 (position of the ram 140) may refer to the front (or upward direction) and a direction from the other side to the one side may refer to the back (or downward direction).

The die backer 125 may be for supporting the die holders 121 and the plurality of dies 130 so that the positions of these are not changed according to the pressure of the ram 140 and may be positioned on the back of the die holder 121. In this case, the die backer 125 may be combined with the die holder 121, the container 110, and the like. In addition, a plurality of openings 126 may be formed on the die backer 125. The plurality of openings 126 may function as flow paths for the aluminum capillary tubes 300 extruded through the plurality of holes 136 of the plurality of dies 130 to be extracted outside. For this, the plurality of openings 126 may be formed to have sizes larger than sizes of the plurality of holes 136 at positions corresponding to the plurality of holes 136.

The die holder 121 and the die backer 125 may be implemented as an assembly to be combined or separated or may also be implemented as an integral mold.

The plurality of holes 136 may be formed on the plurality of dies 130. In other words, as illustrated in FIG. 2C, one hole 136 may be formed on one die 130. However, this is merely an embodiment and the plurality of holes 136 may be formed on the one die 130. In the disclosure, for convenience of description, it is assumed that one hole 136 is formed on one die 130.

Hereinafter, the description will be made regarding one die 130, since the description regarding one die 130 among the plurality of dies 130 may be applied in the same manner to the other dies, unless otherwise noted.

Referring to FIG. 2C, the plurality of dies 130 may include the plurality of holes 136. In other words, the die 130 may include the hole 136 for forming the appearance of the aluminum capillary tube 300.

In this case, the outer diameter 10 of each of the plurality of aluminum capillary tubes 300 may correspond to the diameter of each of the plurality of holes 136. In other words, the outer diameter 10 of the aluminum capillary tube 300 may correspond to the diameter of the hole 136. For example, the diameter of the hole 136 may be a value of 1.8 mm to 3.9 mm by considering a diameter ratio of the aluminum capillary tube 300. In this case, the outer diameter 10 of the aluminum capillary tube 300 may be a value within an error range from the diameter of the hole 136.

Herein, the plurality of dies 130 may respectively include a plurality of mandrels 133 for forming the opening of the aluminum capillary tube 300. In other words, the die 130 may include the mandrel 133 for forming the opening of the aluminum capillary tube 300.

In this case, the inner diameter 20 of each of the plurality of capillary tubes 300 may correspond to the diameter of each of the plurality of mandrels 133. In other words, the inner diameter 20 of the aluminum capillary tube 300 may correspond to the diameter of the mandrel 133. For example, the diameter of the mandrel 133 may be a value of 0.7 mm to 1.0 mm by considering the diameter ratio of the aluminum capillary tube 300. In this case, the inner diameter 20 of the aluminum capillary tube 300 may be a value within an error range from the diameter of the mandrel 133.

The outer diameter 10 of each of the plurality of the aluminum capillary tubes 300 may be determined based on the inner diameter 20 of each of the plurality of aluminum capillary tubes 300. In other words, the outer diameter 10 of the aluminum capillary tube 300 may be determined based on the inner diameter 20 of the aluminum capillary tube 300.

For example, the dimensions of the outer diameter 10 and the inner diameter 20 of the aluminum capillary tube 300 capable of being manufactured may vary depending on the volume of the container 110 of the extrusion apparatus 100, the diameter ratio, the extrusion conditions, and the like, and the dimensions thereof may be generally dimensions satisfying the diameter ratio of 1.7 to 4.9. This may be shown as a table of FIG. 5A.

FIG. 5A shows the outer diameters 10 and the inner diameters 20 of the aluminum capillary tubes 300 capable of being manufactured according to an embodiment of the disclosure.

Referring to FIG. 5A, if the inner diameter 20 of the aluminum capillary tube 300 is a value of 0.7 mm to 0.9 mm, each outer diameter 10 may be determined as a value obtained by multiplying the inner diameter 20 by the diameter ratio (e.g., value of 1.7 to 4.9) as described above. Accordingly, if the inner diameter 20 of the aluminum capillary tube 300 of the disclosure is a value of 0.7 mm to 0.9 mm, the outer diameter 10 thereof may be a value of 1.8 mm to 3.9 mm.

As described above, the dimension of the outer diameter 10 of the aluminum capillary tube 300 may be determined as a value obtained by multiplying the diameter ratio (e.g., value of 1.7 to 4.9) by the dimension of the inner diameter 20. In other words, the dimension of the outer diameter 10 of the aluminum capillary tube 300 may be determined as a value between two values obtained by multiplying the minimum value (e.g., 1.7) and the maximum value (e.g., 4.9) of the diameter ratio by the dimension of the inner diameter 20. The diameter ratio may be a ratio of the outer diameter 10 and the inner diameter 20 and may be a value of 1.7 to 4.9 which may be an experimentally determined value. In particular, if the diameter ratio is less than 1.7, an extrusion ratio may increase due to a decrease in speed of extrusion with respect to a proceeding speed of the ram 140, thereby increasing surface defects of the aluminum capillary tube 300.

Figure 5B:
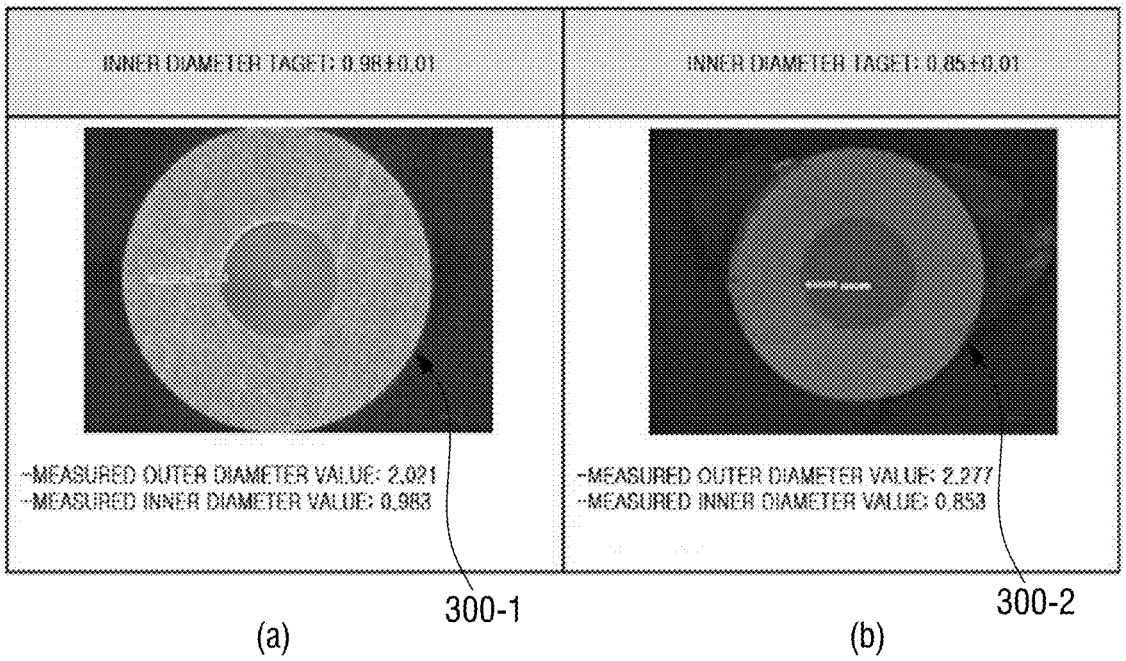
FIG. 5B illustrates a view for explaining an aluminum capillary tube according to an embodiment.

FIG. 5B illustrates a view for comparing satisfactions of design target values of the manufactured aluminum capillary tubes 300. In FIG. 5B, the aluminum billet 200 and the housing mold 120 were preheated at a temperature of 400 to 480 degrees within 5 hours, the aluminum billet 200, after preheating, was inserted into the container 110 of the extrusion apparatus 100, and aluminum capillary tubes 300-1 and 300-2 were manufactured by a direct extrusion method by maintaining a temperature of the container 110 at 400 to 480 degrees and setting an extrusion speed of the ram at 30 to 60 m/min.

It may be found that, if the inner diameter target is set as 0.98±0.01, as shown in (a) of FIG. 5B, the inner diameter 20 of the aluminum capillary tube 300-1 is 0.983 which satisfies a range of inner diameter tolerance of ±0.01, and if the inner diameter target is set as 0.85±0.01, as shown in (b) of FIG. 5B, the inner diameter 20 of the aluminum capillary tube 300-2 is 0.853 which satisfies a range of inner diameter tolerance of ±0.01. Accordingly, a plug drawing process in the manufacturing process of the related art may not be performed. In other words, the aluminum capillary tube 300 satisfying the design specification may be manufactured only through the extrusion process using the extrusion apparatus 100 according to an embodiment of the disclosure, without the drawing process.

As described above, the extrusion apparatus 100 according to an embodiment of the disclosure may manufacture the aluminum capillary tube 300 having the design specification only through the single process of extrusion, thereby exhibiting the effect of cost reduction due to process simplification, compared to a copper capillary tube of the related art manufactured by three-step process such as extrusion, drawing, and thermal treatment.

In at least one die 130 among the plurality of dies, the diameter of the hole 136 or the diameter of the mandrel 133 may be different from that of other dies. Accordingly, the outer diameter 10 and the inner diameter 20 of at least one aluminum capillary tube 300 among the plurality of extruded aluminum capillary tubes may be different from those of other aluminum capillary tubes. As described above, the aluminum capillary tubes 300 having different outer diameters 10 and inner diameters 20 may be extruded at the same time.

The structure of the die 130 will be described in more detail with reference to FIGS. 3A and 3B.

Figure 3A:
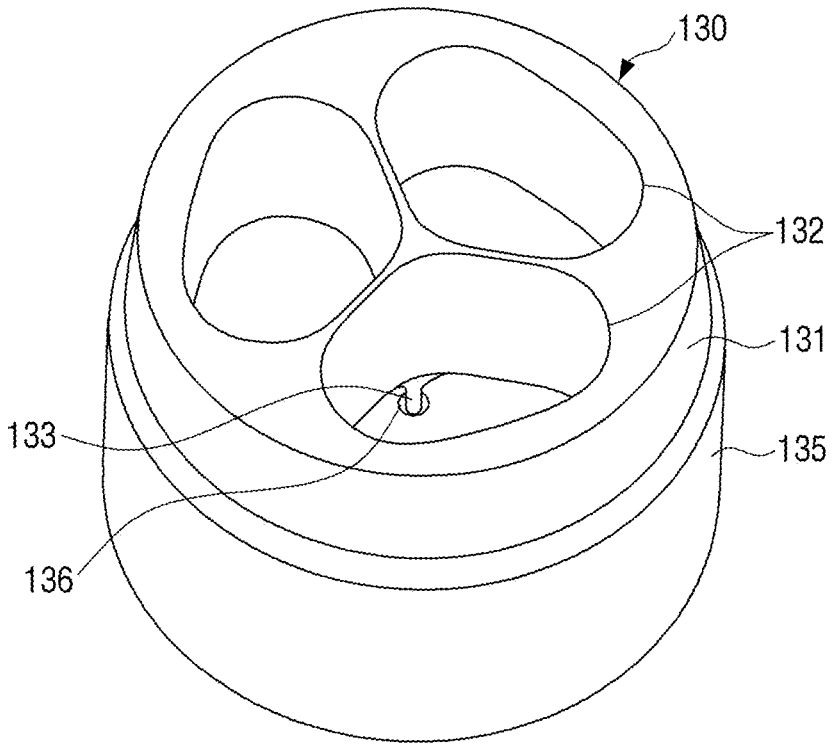
FIG. 3A illustrates a view for explaining a die according to an embodiment.
Figure 3B:
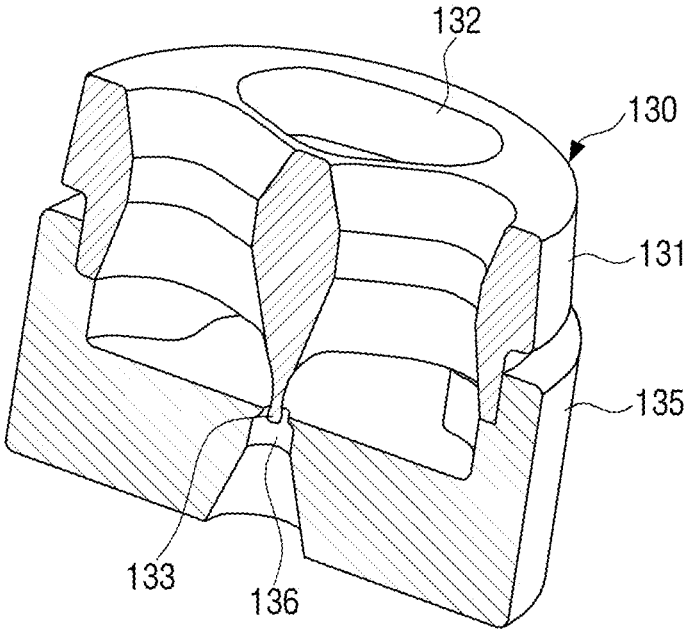
FIG. 3B illustrates a view for explaining the die according to an embodiment.

FIGS. 3A and 3B are views for explaining one die among the plurality of dies according to an embodiment. FIG. 3A illustrates a perspective view of the die and FIG. 3B illustrates a vertical sectional view of the die.

A flow path is necessarily formed so that the aluminum billet 200 passes through the die 130 to be extruded into the aluminum capillary tube 300, when the aluminum billet 200 pressed by the ram 140 flows and passes through the die 130.

In an embodiment, the die 130 may be implemented as an assembly of an upper die 131 and a lower die 135. The upper die 131 may be formed with at least one inlet 132 and the mandrel 133 and the lower die 135 may be formed with the hole 136. The upper die 131 and the lower die 135 may be combined with each other or separated from each other or may also be realized in an integral form not separated from each other, in some cases.

The inlet 132 of the upper die 131 and the hole 136 of the lower die 135 may be connected to each other and may function as a path for the aluminum billet 200 pressed by the ram 140 to be extruded into the aluminum capillary tube 300 through the hole 136 of the lower die 135. The inlet 132 of the upper die 131 may have an area of a cross section which increases towards the upwards direction by considering the flow of the aluminum billet 200.

As described above, as illustrated in FIG. 2C, the mandrel 133 may be positioned at the center of the hole 136, and the aluminum billet 200 may flow to a space of the hole 136 except for the mandrel 133 to be extruded into the aluminum capillary tube 300. In other words, when the aluminum billet 200 is pressed by the ram 140, appearance of the aluminum capillary tube 300 may be formed in an area, through which the pressed aluminum billet 200 is able to pass through the hole 136, and the opening of the hollow aluminum capillary tube 300 may be formed in an area, through which the pressed aluminum billet 200 is not able to pass by the mandrel 133.

Hereinafter, a manufacturing method according to an embodiment of the disclosure will be described with reference to FIGS. 4 to 7.

Figure 4:
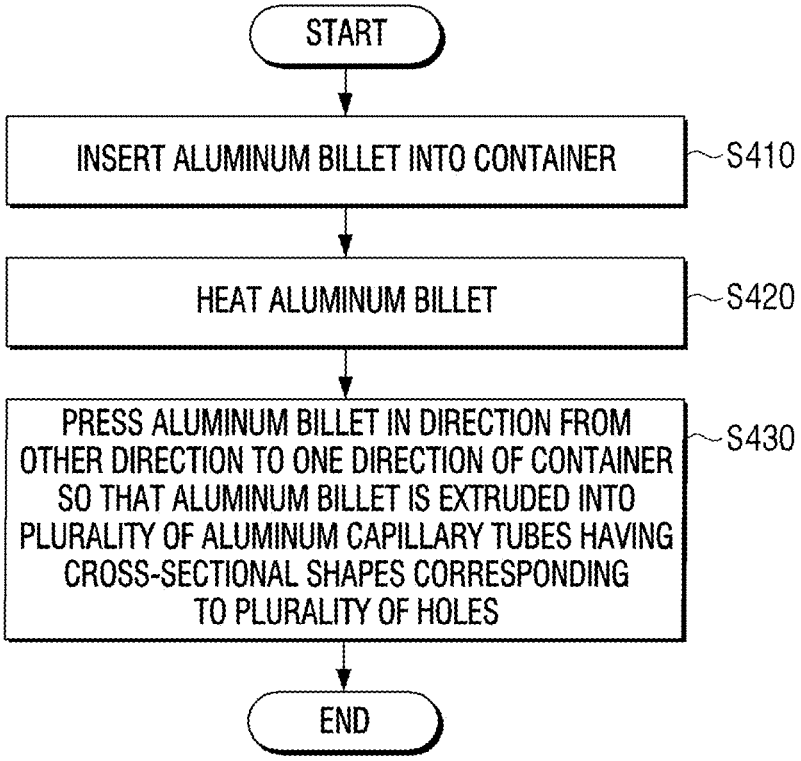
FIG. 4 illustrates a flowchart for explaining a method for manufacturing an aluminum capillary tube according to an embodiment.

FIG. 4 illustrates a flowchart for explaining a method for manufacturing the aluminum capillary tube using the extrusion apparatus according to an embodiment.

Referring to FIG. 4, according to an embodiment of the disclosure, a method for manufacturing the aluminum capillary tube 300 using the extrusion apparatus 100 including the container 110, and the housing mold 120 provided on one side of the container 110 and including the plurality of dies 130 formed with the plurality of holes 136, includes: inserting the aluminum billet 200 to the container 110 (S410); heating the aluminum billet 200 (S420); and pressing the aluminum billet 200 in a direction from another side to the one side of the container 110 so that the aluminum billet 200 is extruded into the plurality of aluminum capillary tubes 300 having cross-sectional shapes corresponding to the plurality of holes 136 (S430), and the number of the plurality of holes 136 is determined based on the inner diameter of the container 110 and the diameter of each of the plurality of holes 136. In this case, the detailed description regarding the extrusion apparatus 100 may be applied in the same manner, and therefore the overlapped description will not be repeated.

Specifically, in the manufacturing method according to an embodiment of the disclosure, the aluminum billet 200 may be inserted to the container 110 (S410).

Herein, the aluminum billet 200 to be inserted to the container 110 may be manufactured through a dissolution process, an alloying process, a degassing treatment process, and the like. For example, the aluminum billet 200 may be manufactured by melting aluminum at a temperature of 650 to 750 degrees, adding an alloying element to the melted aluminum, allowing alloying by holding the mixture for 10 minutes to 1 hour, and performing degassing treatment by injecting inert gas (e.g., argon bubbling gas). The aluminum billet 200 may contain 0.20 to 0.40% by weight of Mg; 0.20 to 0.60% by weight of Zn; and a balance of Al. Specifically, local corrosion (pitting or crevice corrosion) of the aluminum billet 200 may be reduced by at least one of the $Mg_{32}(Al, Zn)_{49}$ phase and the $Al_3Mg_2$ phase contained in the aluminum billet 200. In addition, since the fraction of the $Mg_{32}(Al, Zn)_{49}$ phase does not exceed 0.05% and the fraction of the $Al_3Mg_2$ phase does not exceed 0.02%, the workability for extrusion or drawing may be ensured. Further, the thermal treatment may be performed by heating the aluminum billet 200 within 24 hours from the time when the aluminum billet 200 is manufactured at 460 to 500 degrees so that the aluminum billet 200 sufficiently employs the alloying elements added to the aluminum billet 200.

Next, the aluminum billet 200 may be heated (S420). Specifically, when the aluminum billet 200 is inserted to the container 110, the aluminum billet 200 accommodated in the container 110 may be heated at a predetermined temperature (e.g., 400 to 480 degrees). This is for increasing fluidity of the aluminum billet 200 to be extruded.

According to an embodiment of the disclosure, in the heating the aluminum billet 200, the preheating treatment may be performed by heating the aluminum billet 200 and the housing mold 120 at a predetermined temperature (e.g., 400 to 480 degrees) for a predetermined period of time (e.g., 5 hours) before inserting the aluminum billet 200 to the container 110. In this case, the aluminum billet 200 may be inserted to the container 110 after performing the preheating treatment (S410).

Next, the aluminum billet 200 may be pressed in a direction from the other side to the one side of the container 110, so that the aluminum billet 200 is extruded into the plurality of aluminum capillary tubes 300 having cross-sectional shapes corresponding to the plurality of holes 136.

For example, the aluminum billet 200 may be pressed in a direction from the other side to the one side of the container 110 at an extrusion speed of 30 to 60 m/min. Accordingly, the aluminum billet 200 may be extruded into the plurality of aluminum capillary tubes 300 having cross-sectional shapes corresponding to the plurality of holes 136.

The plurality of dies 130 may be respectively formed with the plurality of holes 136 for forming appearance of the aluminum capillary tubes 300. When the aluminum billet 200 is extruded into the plurality of aluminum capillary tubes 300, the cross-sectional shapes of the plurality of aluminum capillary tubes 300 may correspond to the plurality of holes 136 formed on the plurality of dies 130. In other words, the cross-sectional shape of the aluminum capillary tube 300 may correspond to the hole 136 formed on the die 130. For example, when projecting the plurality of holes 136 on a plane vertical to the pressing direction, the smallest area among the projected areas may be the cross-sectional shape of the plurality of aluminum capillary tubes 300.

The plurality of dies 130 may include the plurality of holes 136. In other words, the die may include the hole 136 for forming the appearance of the aluminum capillary tube 300.

In this case, the outer diameter 10 of each of the plurality of aluminum capillary tubes 300 may correspond to the diameter of each of the plurality of holes 136. In other words, the outer diameter 10 of the aluminum capillary tube 300 may correspond to the diameter of the hole 136. For example, the outer diameter 10 of the aluminum capillary tube 300 may be a value within an error range from the diameter of the hole 136.

Herein, the plurality of dies 130 may respectively include the plurality of mandrels 133 for forming the openings of the aluminum capillary tubes 300. In other words, the die 130 may include the mandrel 133 for forming the opening of the aluminum capillary tube 300.

In this case, the inner diameter 20 of each of the plurality of capillary tubes 300 may correspond to the diameter of each of the plurality of mandrels 133. In other words, the inner diameter 20 of the aluminum capillary tube 300 may correspond to the diameter of the mandrel 133. For example, the inner diameter 20 of the aluminum capillary tube 300 may be a value within an error range from the diameter of the mandrel 133.

The outer diameter 10 of each of the plurality of the aluminum capillary tubes 300 may be determined based on the inner diameter 20 of each of the plurality of aluminum capillary tubes 300. In other words, the outer diameter 10 of the aluminum capillary tube 300 may be determined based on the inner diameter 20 of the aluminum capillary tube 300. This has been described above with reference to FIG. 5A, and therefore the description will not be repeated.

The manufacturing method according to an embodiment of the disclosure may further include, based on the plurality of aluminum capillary tubes 300 being extruded with a predetermined length, cutting the plurality of aluminum capillary tubes 300. The predetermined length may refer to a length determined by considering the outer diameter 10, the inner diameter 20, and the like of the aluminum capillary tube 300.

For example, when the plurality of aluminum capillary tubes 300 are extruded at a specific speed according to the proceeding speed of the ram 140 and the extrusion ratio, the plurality of aluminum capillary tubes 300 may be cut for each regular length or time through a separate trim winder.

The manufacturing method according to an embodiment of the disclosure may further include performing drawing with respect to the plurality of extruded aluminum capillary tubes 300 after extruding the plurality of aluminum capillary tubes 300. The drawing is cold working mostly performed at a room temperature and is a method for drawing a material to be processed to reduce a cross section area of the material. This is for dimension stability and improvement of mechanical physical properties.

Herein, as shown in FIG. 6, the drawing may be set to be performed once so that a cross section reduction ratio of the aluminum capillary tube 300 due to the drawing is less than 40%. In other words, after the plurality of aluminum capillary tubes 300 are extruded, the drawing may be performed once with respect to the plurality of extruded aluminum capillary tubes 300. This is for minimizing and/or reducing stress corrosion of the aluminum capillary tube 300 due to work hardening.

The manufacturing method may further include, based the plurality of aluminum capillary tubes 300 being extruded with a predetermined length, cutting the plurality of aluminum capillary tubes 300. The predetermined length may refer to a length determined by considering the outer diameter 10, the inner diameter 20, and the like of the aluminum capillary tube 300.

Figure 7:
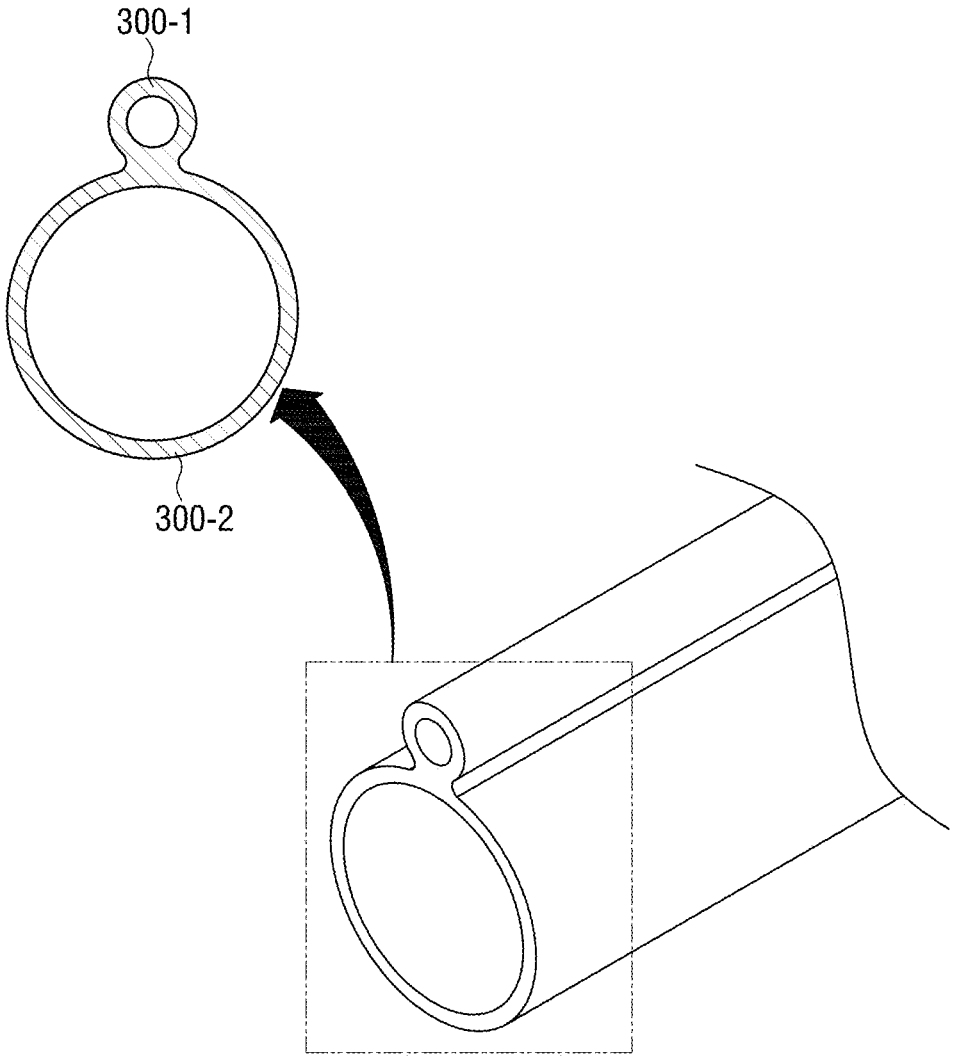
FIG. 7 illustrates a view for explaining the manufacturing method according to an embodiment.

Referring to FIG. 7, the manufacturing method according to an embodiment of the disclosure may further include bonding the plurality of extruded aluminum capillary tubes 300-1 and 300-2 to each other while the plurality of aluminum capillary tubes 300 are extruded by pressing the aluminum billet 200.

The manufacturing method may further include, based on the plurality of bonded aluminum capillary tubes 300-1 and 300-2 being extruded with a predetermined length, cutting the plurality of bonded aluminum capillary tubes 300-1 and 300-2.

In this case, in an embodiment, at least one die 130 of the plurality of dies may have a diameter of the hole 136 or a diameter of the mandrel 133 different from that of other dies. Accordingly, the outer diameter 10 and the inner diameter 20 of at least one aluminum capillary tube 300 among the plurality of extruded aluminum capillary tubes may be different from those of other aluminum capillary tubes.

According to an embodiment of the disclosure described above, as illustrated in FIG. 7, the aluminum capillary tubes 300 having different outer diameters 10 and inner diameters 20 are bonded to each other while extruding at the same time, thereby improving productivity by simplifying the process.

According to the embodiments of the disclosure, it is possible to provide an extrusion apparatus for manufacturing a capillary tube satisfying a design diameter while maintaining original material properties and corrosion resistance of the aluminum alloy, and a method for manufacturing an aluminum capillary tube using the same.

According to the embodiments of the disclosure, the aluminum capillary tube manufactured by the extrusion apparatus according to the method for manufacturing the aluminum capillary tube using the same may have high corrosion resistance while maintaining physical and chemical properties of the original aluminum material. In addition, since the drawing and annealing processes are not performed after the extrusion, an effect of cost reduction through process simplification may be exhibited, and accordingly, the aluminum capillary tube of the disclosure may be replaced with the copper capillary tube.

In addition, the same reference numerals and symbols in each drawing accompanying in the specification may represent parts or elements performing substantially the same function. For convenience of description and understanding, the same reference numerals or symbols are used and described in the different embodiments. In other words, although the elements with the same reference numerals are illustrated in all of the plurality of drawings, the plurality of drawings does not mean one embodiment.

A term such as "module", "unit", or "part" in the embodiments of the disclosure are terms for referring to elements performing at least one function or operation, and such elements may be implemented as hardware, software, or a combination of hardware and software. In addition, except for when each of a plurality of "modules", "units", "parts", and the like needs to be realized in an individual specific hardware, the elements may be integrated in at least one module or chip and be implemented in at least one processor.

Although the present disclosure has been described with various embodiments, various changes and modifications may be suggested to one skilled in the art. It is intended that the present disclosure encompass such changes and modifications as fall within the scope of the appended claims.

What is claimed is:

1. An extrusion apparatus comprising:

a container;

a housing mold provided on one side of the container, the housing mold comprising a plurality of dies, each of the plurality of dies formed with a hole such that the housing mold comprises a plurality of holes; and a ram configured to press an aluminum billet accommodated in the container in a direction from another side to the one side of the container so that the aluminum billet accommodated in the container is extruded, through each of the plurality of dies, into a plurality of aluminum capillary tubes, each of the plurality of aluminum capillary tubes having cross-sectional shapes corresponding to a hole of a die through which each of the plurality of aluminum capillary tubes passes among the plurality of dies, wherein a number of the plurality of holes is determined based on an inner diameter of the container and a diameter for each of the plurality of holes, and wherein at least one die of the plurality of dies has a hole diameter different from a hole diameter of another die of the plurality of dies.

2. The extrusion apparatus according to claim 1, wherein each of the plurality of dies comprises a mandrel configured to form an opening of a corresponding aluminum capillary tube.

3. The extrusion apparatus according to claim 2, wherein a diameter of the mandrel of a respective die corresponds to an inner diameter of the corresponding aluminum capillary tube corresponding to the respective die.

4. The extrusion apparatus according to claim 2, wherein a diameter of the hole of a corresponding die is determined based on the inner diameter of the corresponding aluminum capillary tube.

5. The extrusion apparatus according to claim 2, wherein the mandrel has a diameter between 0.7 mm and 1.0 mm.

6. The extrusion apparatus according to claim 1, further comprising a heater for heating the aluminum billet accommodated in the container.

7. The extrusion apparatus according to claim 1, wherein the ram is configured to press the aluminum billet at a speed of 30 m/min to 60 m/min.

8. A manufacturing method for manufacturing an aluminum capillary tube using an extrusion apparatus comprising a container, and a housing mold provided on one side of the container and comprising a plurality of dies, each of the plurality of dies formed with a hole such that the housing mold comprises a plurality of holes, the method comprising:

inserting an aluminum billet to the container;

heating the aluminum billet; and pressing the aluminum billet in a direction from another side to the one side of the container so that the aluminum billet is extruded, through a hole of each of the plurality of dies, into a plurality of aluminum capillary tubes, each of the plurality of aluminum capillary tubes having cross-sectional shapes corresponding to a hole of a die through which each of the plurality of aluminum capillary tubes passes among the plurality of dies, wherein a number of the plurality of holes is determined based on an inner diameter of the container and a diameter of each of the plurality of holes, and wherein at least one die of the plurality of dies has a hole diameter different from a hole diameter of another die of the plurality of dies.

9. The manufacturing method according to claim 8, wherein each of the plurality of dies comprises a mandrel configured to form an opening of a corresponding aluminum capillary tube.

10. The manufacturing method according to claim 9, wherein a diameter of the mandrel of a respective die corresponds to an inner diameter of the corresponding aluminum capillary tube corresponding to the respective die.

11. The manufacturing method according to claim 9, wherein a diameter of the hole of a corresponding die is determined based on the inner diameter of the corresponding aluminum capillary tube.

12. The manufacturing method according to claim 9, wherein the mandrel has a diameter between 0.7 mm and 1.0 mm.

13. The manufacturing method according to claim 8, further comprising bonding each of plurality of extruded aluminum capillary tubes together while each of the plurality of aluminum capillary tubes is extruded by pressing the aluminum billet.

14. The manufacturing method according to claim 8, further comprising, based on each of the plurality of aluminum capillary tubes being a predetermined length, cutting the plurality of aluminum capillary tubes.

15. The manufacturing method according to claim 8, wherein the aluminum billet comprises:

0.20 to 0.40% by weight of Mg;

0.20 to 0.60% by weight of Zn; and a balance of Al.

16. The manufacturing method according to claim 8, wherein the pressing of the aluminum billet is performed at a speed of 30 m/min to 60 m/min.

* * * * *